US005558106A

United States Patent [19]

Der

[11] Patent Number: 5,558,106

[45] Date of Patent: Sep. 24, 1996

[54] HAIR CLIP COMBINATION DEVICE

[76] Inventor: Ou Y. M. Der, P.O. Box 82-144, Taipei, Taiwan

[21] Appl. No.: 515,898

[22] Filed: Aug. 16, 1995

[51] Int. Cl.[6] ..... A45D 8/12

[52] U.S. Cl. ..... 132/275; 132/276; 132/278; 132/273

[58] Field of Search ..... 132/275, 276, 132/273, 278

[56] References Cited

U.S. PATENT DOCUMENTS 1,434,895 11/1922 Heossner ..... 132/278
3,106,215 10/1963 Grandis et al. ..... 132/278

*Primary Examiner*—Gene Mancene
*Assistant Examiner*—Pedro Philogene
*Attorney, Agent, or Firm*—Alfred Lei

[57] ABSTRACT

A hair clip combination device including a base, which has an insertion hole at one end and a retainer rod at an opposite end, a holder member shaped like the receptacle of a flower and fastened to the base by a screw, which has a bottom coupling groove, which receives the retainer rod, a bevel opening, which receives a coupling block at one end of the retainer rod, and an insertion hole, a petal-like cover fastened to the base by a screw, a pistil-like extension rod for mounting between the petal-like cover and the base, a metal clip for fastening to the bottom side of the base for securing it to the hair, a pin for insertion through the insertion hole of the base and the insertion hole of the holder member to hold down the hair, and a clamping plate for insertion into the insertion hole of the base to work with the retainer rod in holding down the hair.

4 Claims, 9 Drawing Sheets

HAIR CLIP COMBINATION DEVICE

BACKGROUND OF THE INVENTION

1. Field of the Invention

The present invention relates to a hair clip combination device which can be alternatively arranged into three different forms for fastening the hair in different shapes.

2. Description of the Invention

A variety of hair clips have been disclosed for keeping the hair in place and decorating it, and have appeared on the market. However, regular hair clips have limitation in use, because they cannot be changed into different forms for fastening the hair in different shapes.

SUMMARY OF THE INVENTION

This invention is related to a hair clip combination device which can be alternatively arranged into different forms for fastening the hair in different shapes.

According to the preferred embodiment of the present invention, the hair clip combination device a base, which has an insertion hole at one end and a retainer rod at an opposite end, a holder member shaped like the receptacle of a flower and fastened to the base by a screw, which has a bottom coupling groove, which receives the retainer rod, a bevel opening, which receives a coupling block at one end of the retainer rod, and an insertion hole, a petal-like cover fastened to the base by a screw, a pistil-like extension rod for mounting between the petal-like cover and the base, a metal clip for fastening to the bottom side of the base for securing it to the hair, a pin for insertion through the insertion hole of the base and the insertion hole of the holder member to hold down the hair, and a clamping plate for insertion into the insertion hole of the base to work with the retainer rod in holding down the hair.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
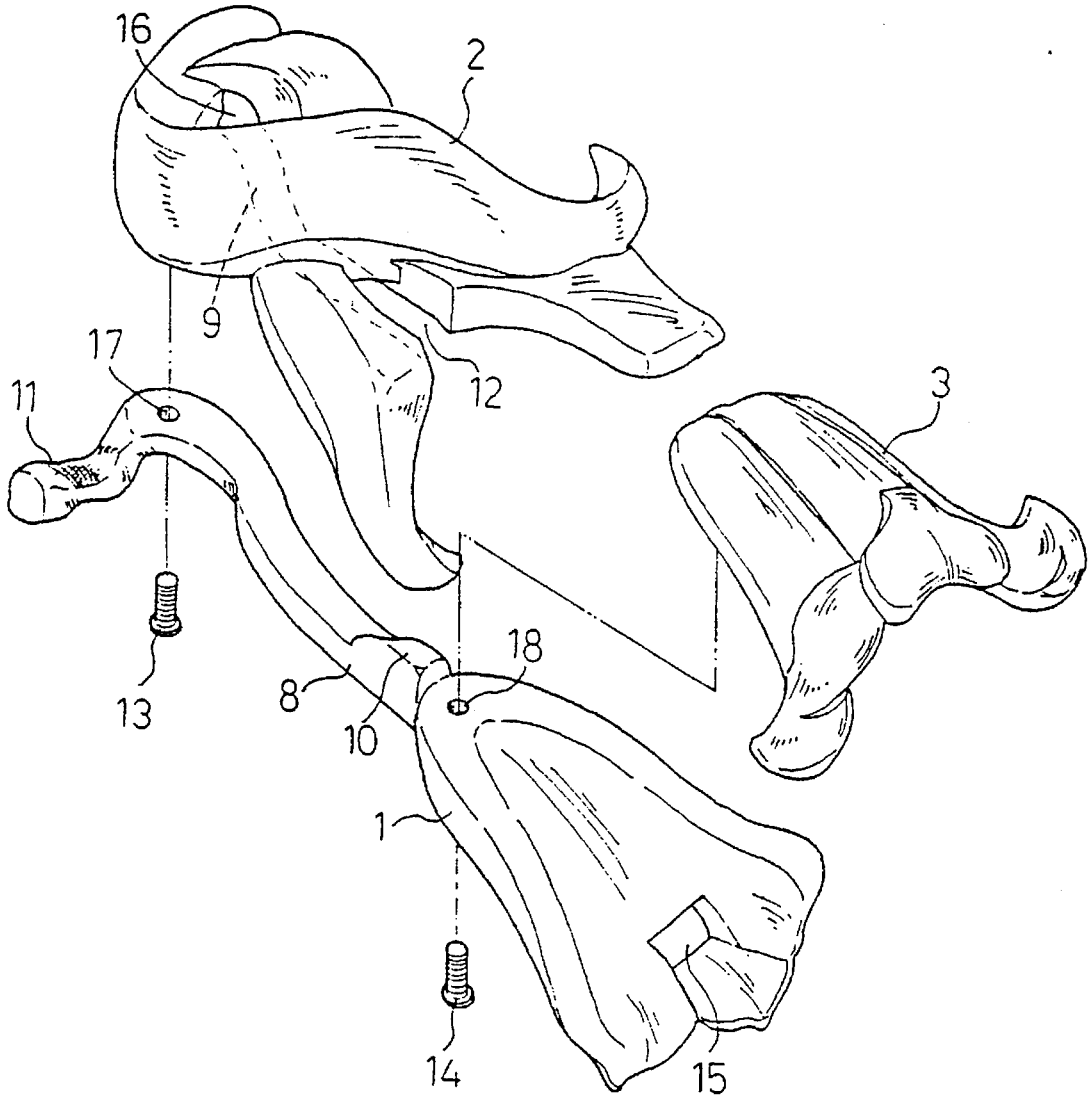
FIG. 1 is an exploded view of the base, holder base and cover of the hair clip combination device according to the present invention.
Figure 2:
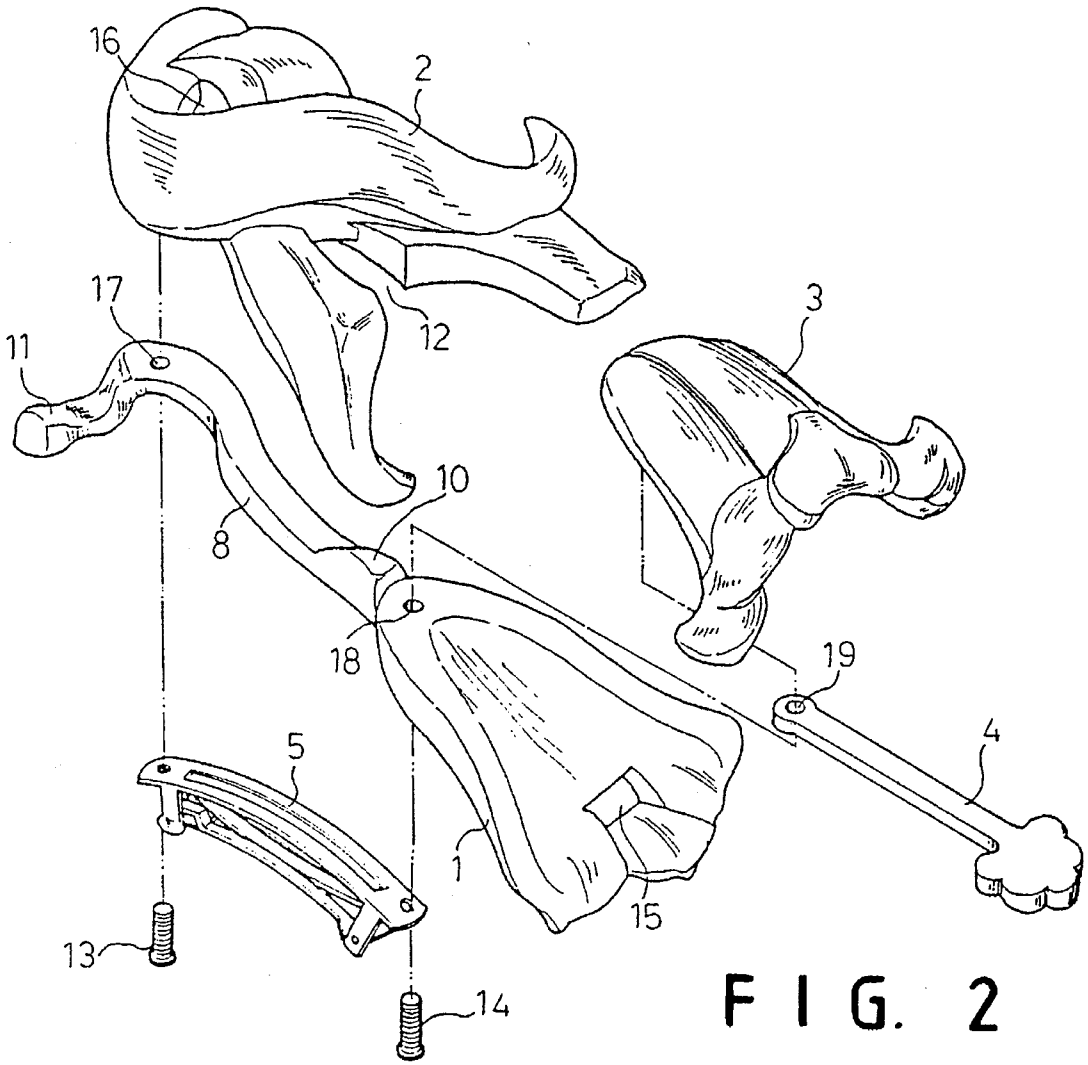
FIG. 2 is an exploded view of a first arrangement of the present invention.
Figure 3:
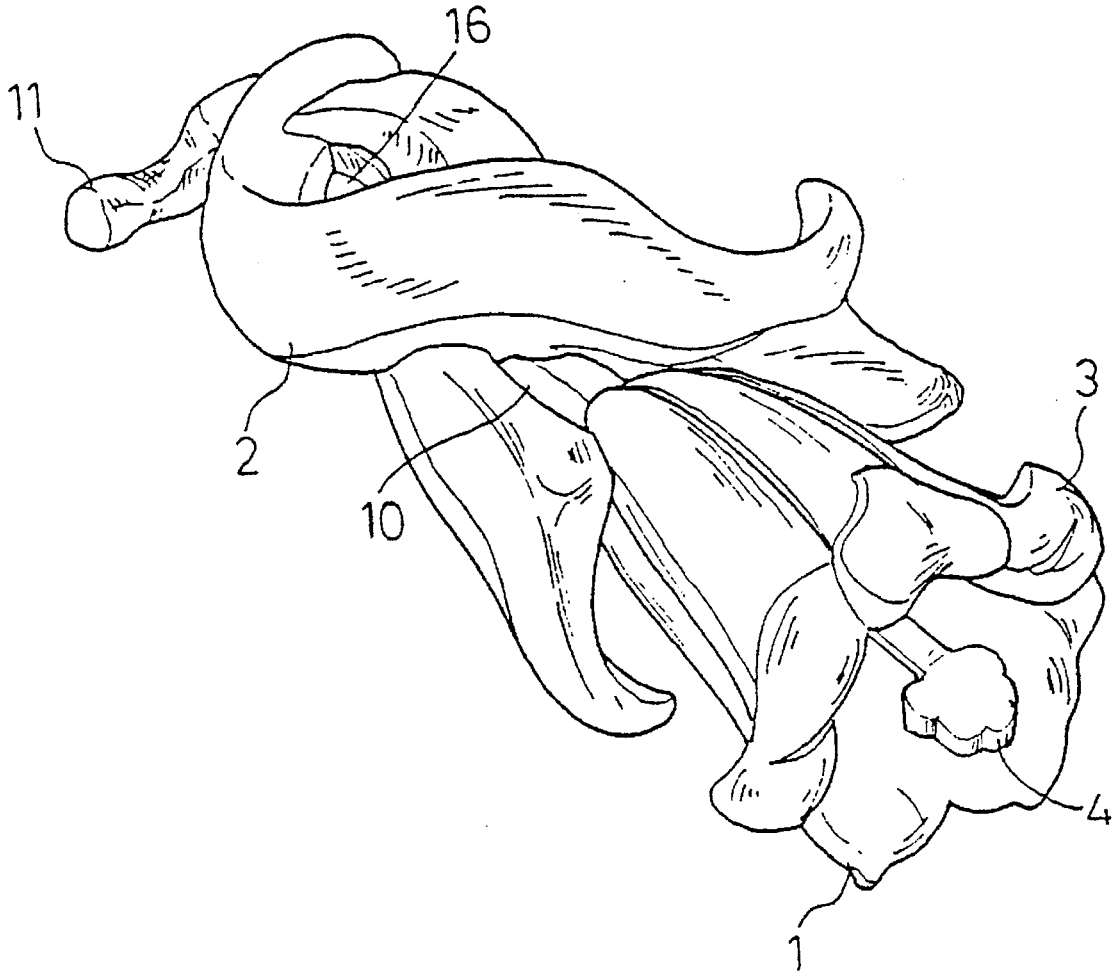
FIG. 3 is an assembly view of FIG. 2.

For the purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Referring to FIGS. from 1 to 7, a hair clip combination device in accordance with the present invention is generally comprised of a base 1, a holder member 2 shaped like the receptacle of a flower, a petal-like cover 3, a pistil-like extension rod 4, a metal clip 5, a pin 6, and a clamping rod 7. The base 1 has a retainer rod 8 at one end, an insertion hole 15 at an opposite end, and a through hole 18 adjacent to the retainer rod 8. The retainer rod 8 comprises a coupling block 10 at one end adjacent to the through hole 18, a clamping tip 11 at an opposite end, and a through hole 17 adjacent to the clamping tip 11. The holder member 2 comprises a bottom coupling groove 9, which receives the retainer rod 8 of the base 1, a bevel opening 12 and an insertion hole 16 at two opposite ends of the bottom coupling groove 9. The bevel opening 12 is for engagement with the coupling block 10 of the retainer rod 8 of the base 1. The petal-like cover 3 is covered on the base 1 and secured to the through hole 18. The extension rod 4 is mounted between the base 1 and the petal-like cover 3, having an eye end 19 connected to the through hole 18. The metal clip 5 is fastened to the bottom side of the base 1, having one end fastened to the through hole 18 of the base 1 and the eye end 19 of the extension rod 4 and a screw hole (not shown) on the bottom side of the petal-like cover 3 by a screw 14, and an opposite end fastened to the through hole 17 of the retainer rod 8 of the base 1 and a screw hole (not shown) on the bottom side of the holder member 2 by a screw 13. The pin 6 is for insertion through the insertion hole 15 of the base 1 and the insertion hole 16 of the holder member 2 to hold down the hair. The clamping rod 7 is for insertion into insertion hole 15 of the base 1 to act with clamping tip 11 of the retainer rod 8 of the base 1 in holding down the hair.

Figure 8:
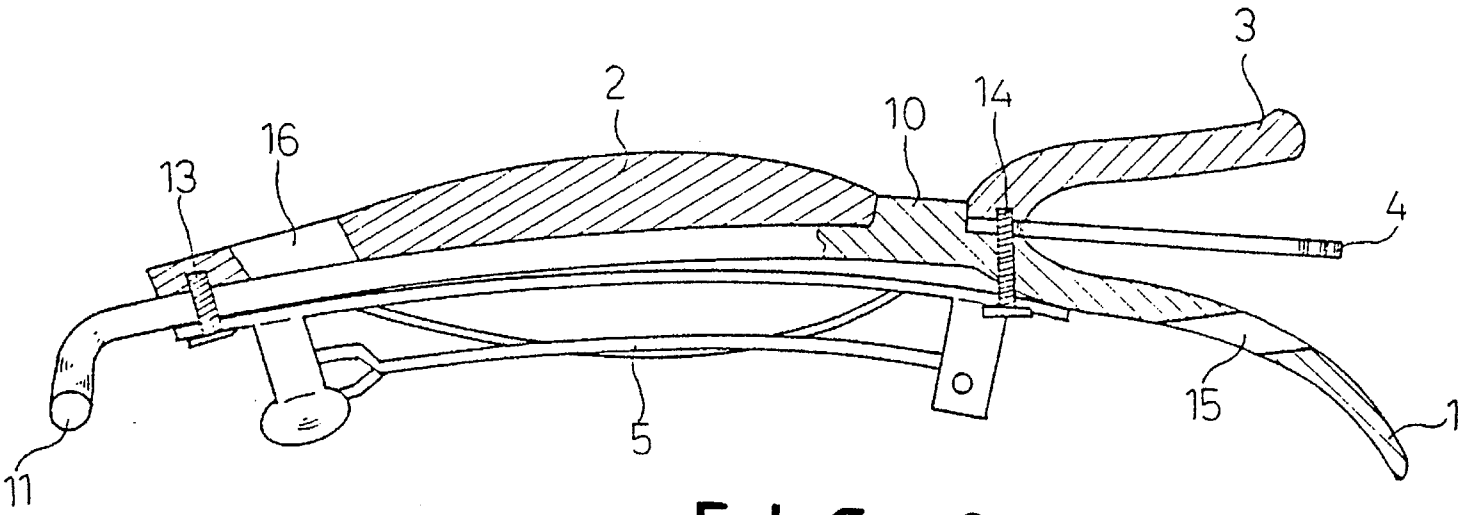
FIG. 8 is a side view in section of FIG. 3.
Figure 9:
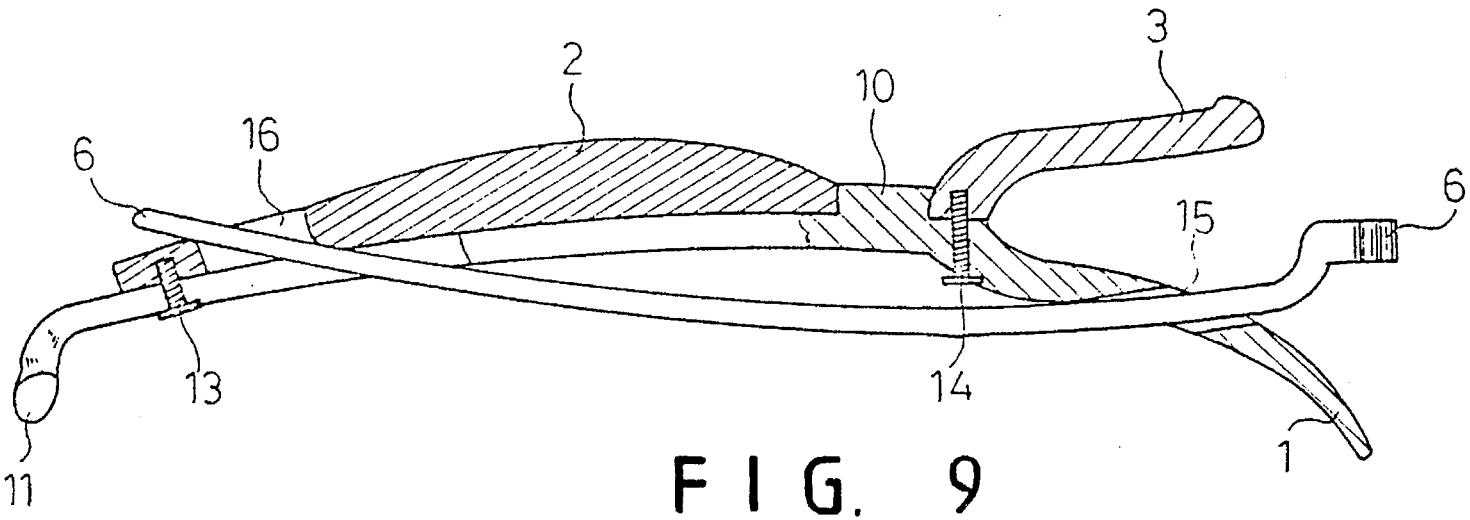
FIG. 9 is a side view in section of FIG. 5.
Figure 10:
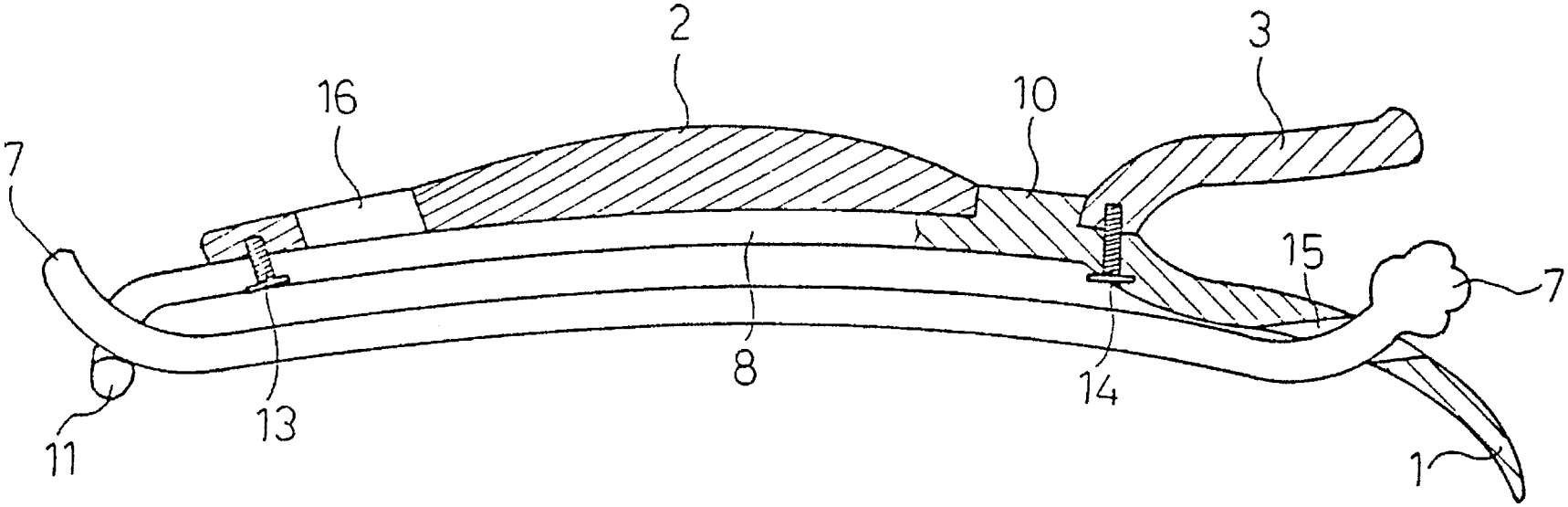
FIG. 10 is a side view in section of FIG. 7.

The hair clip combination device can be alternatively arranged into any of various forms as shown in FIGS. 8, 9, and 10.

Referring to FIGS. 1, 2, 3, and 8, the holder member 2 is coupled to the base 1 by fitting the retainer rod 8 into the bottom coupling groove 9 and engaging the coupling block 10 into the bevel opening 12, then the petal-like cover 3 is covered on the base 1 to hold the extension rod 4 on the inside, and then the metal clip 5 is fastened to the through holes 17 and 18 of the base 1 by the screws 13 and 14. When assembled, the metal clip 5 is used for fastening the hair, the base 1, the holder member 2, the petal-like cover 3, and the extension rod 4 form a decorative artificial flower.

Figure 4:
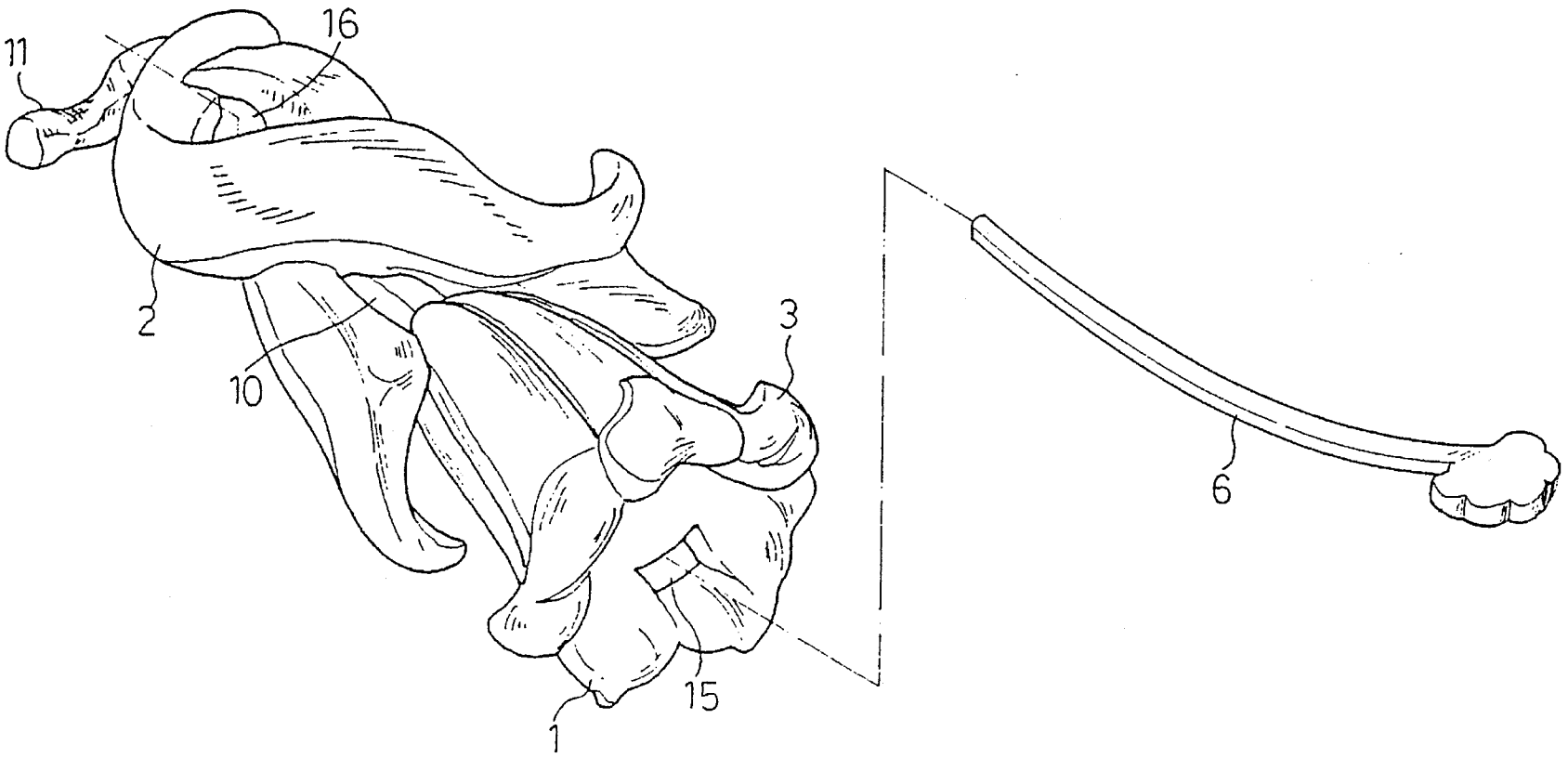
FIG. 4 is an exploded view of a second arrangement of the present invention.
Figure 5:
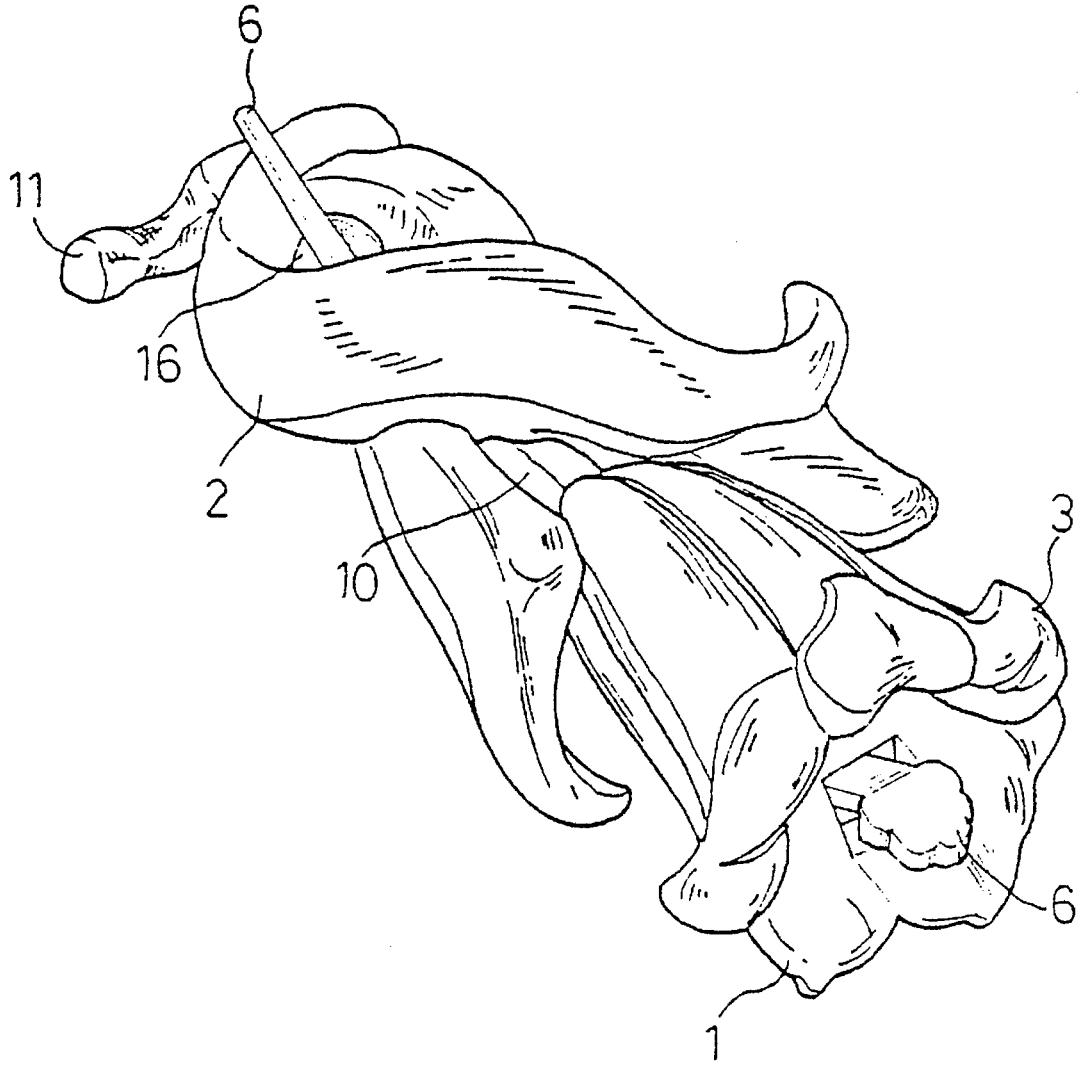
FIG. 5 is an assembly view of FIG. 4.

Referring to FIGS. 4, 5, and 9, the holder member 2 and the petal-like cover 3 are fastened to the base 1 by the screws 13 and 14, and then the pin 6 is inserted through the insertion hole 15 of the base 1 and the insertion hole 16 of the holder member 2 to work with the base 1 in holding down the hair.

Figure 6:
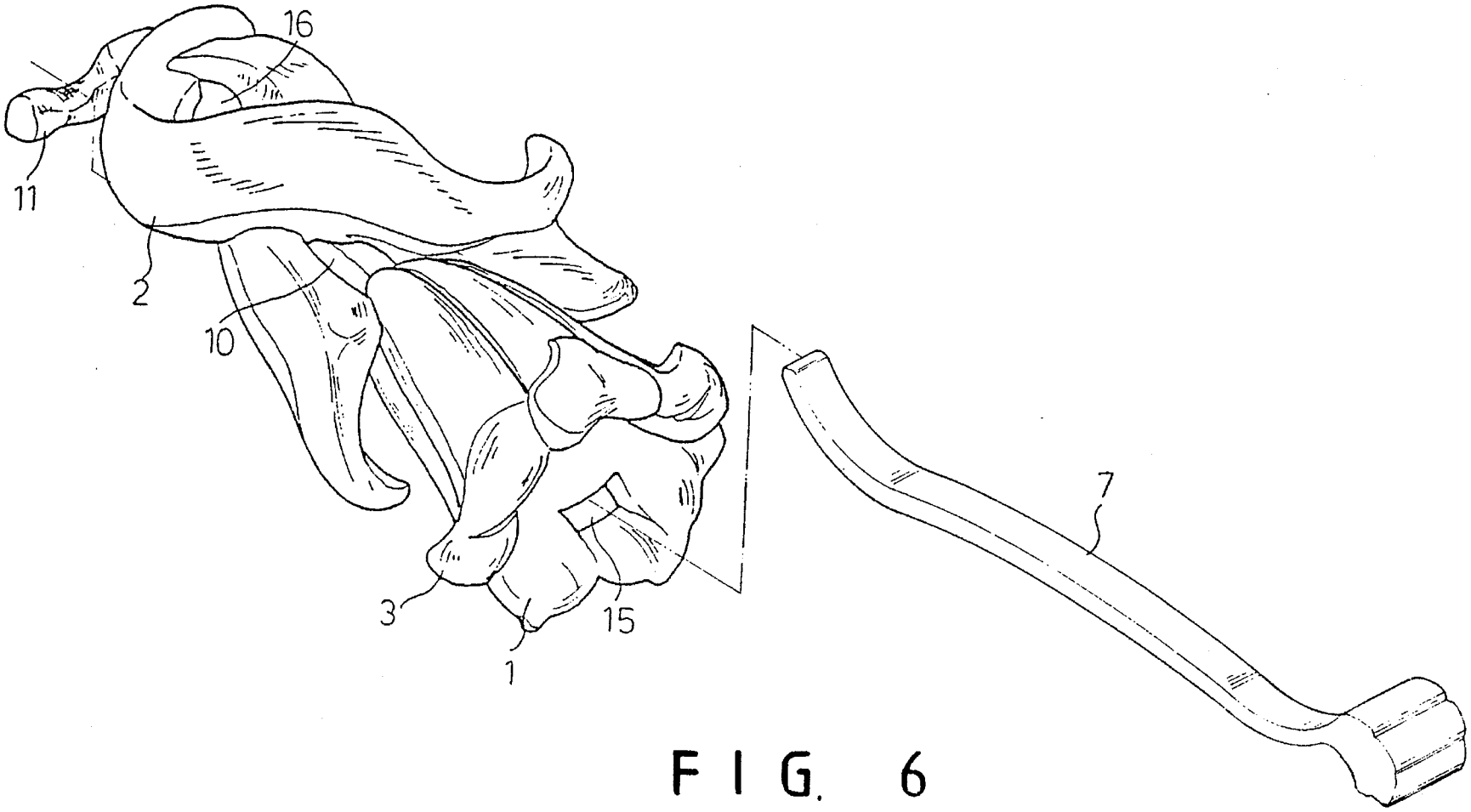
FIG. 6 is an exploded view of a third arrangement of the present invention.
Figure 7:
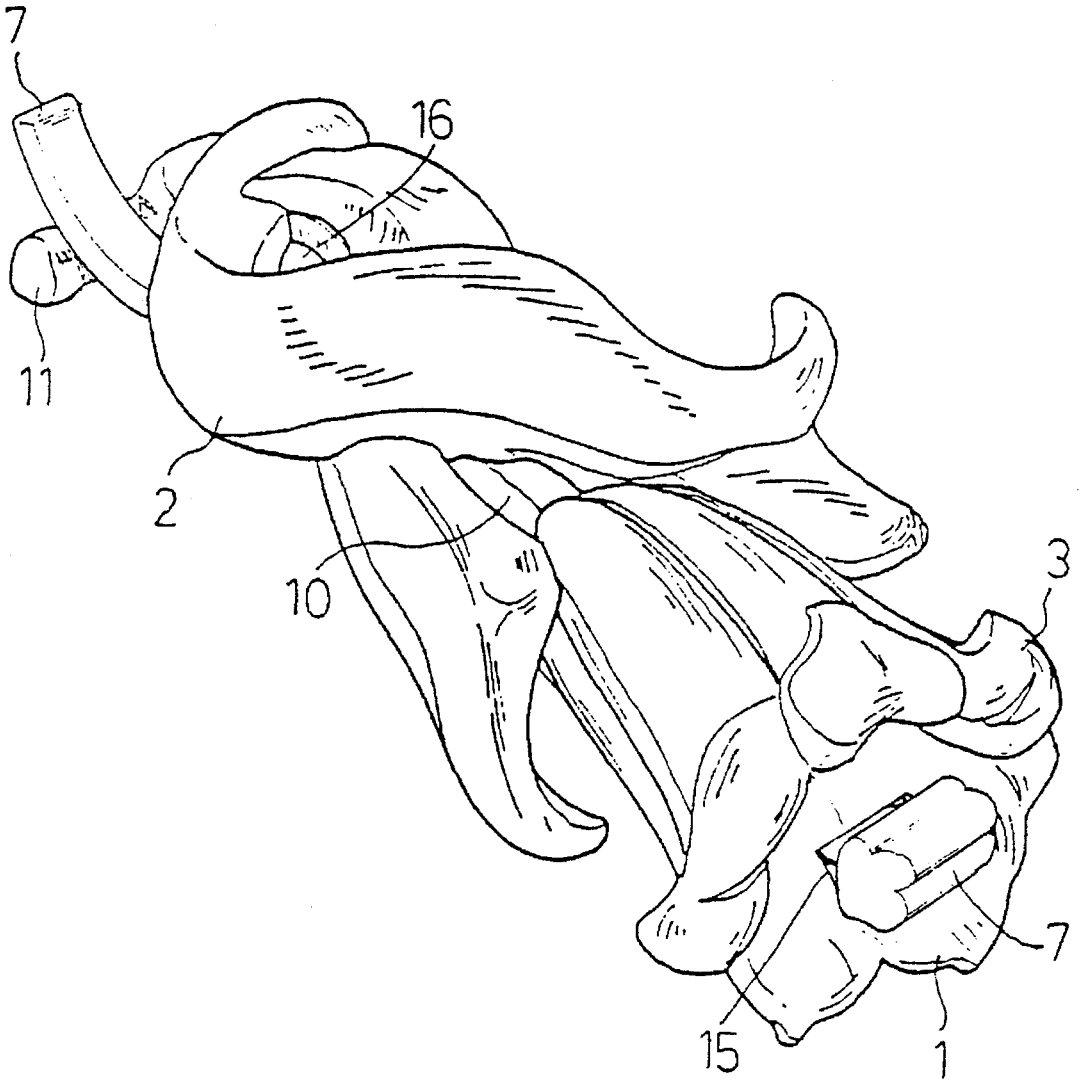
FIG. 7 is an assembly view of FIG. 6.

Referring to FIGS. 6, 7, and 10, the holder member 2 and the petal-like cover 3 are fastened to the base 1 by the screws 13 and 14, and then the clamping rod 7 is inserted into insertion hole 15 of the base 1 to act with clamping tip 11 of the retainer rod 8 of the base 1 in holding down the hair.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A hair clip kit device comprising a base, a holder member shaped like the receptacle of a flower and fastened to said base at one side, a petal-like cover covered on said base and abutted against said holder member, a petal-like extension rod for mounting between said base and said petal-like cover, a metal clip fastened to a bottom side of said base, a pin for securing said base to hair, and a clamping rod for securing said base to the hair, wherein said base comprises a retainer rod at one end, a first through hole adjacent to said retainer rod, a coupling block at one end of said retainer rod, a clamping tip at an opposite end of said retainer rod, and a second through hole on said retainer rod adjacent to said clamping tip; said holder member is fastened to the second through hole of said base by a screw, has a bottom coupling groove, which receives said retainer rod, and a bevel opening at one end of said bottom coupling groove which receives the coupling block of said base; said petal-like cover is fastened to the first through hole of said base by a screw.

2. The hair clip combination device of claim 1 wherein said extension rod has an eyed end fastened to the screw at the first through hole of said base.

3. The hair clip combination device of claim 1 wherein said base has an insertion hole at one end remote from said retainer rod; said holder member has an insertion hole at one end of said bottom coupling groove remote from said bevel opening; said pin is adapted to be inserted through the insertion hole of said base and the insertion hole of said holder member to hold down the hair.

4. The hair clip combination device of claim 1 wherein said clamping rod is adapted to be inserted through an insertion hole at one end of said base remote from said retainer rod, to act with the clamping tip of said retainer rod in holding down the hair.

* * * * *